US005403449A

United States Patent [19]

Farmer

[11] Patent Number: 5,403,449

[45] Date of Patent: Apr. 4, 1995

[54] METHODS AND APPARATUS FOR ELECTRICALLY COUPLING ELECTRICAL CONDUCTORS WITH A CONDUCTIVE ALLOY HAVING A LOW MELTING POINT

[76] Inventor: Thomas E. Farmer, 1602 Biovu, Galveston, Tex. 7751

[21] Appl. No.: 232,611

[22] Filed: Apr. 25, 1994

Related U.S. Application Data

[63] Continuation-in-part of Ser. No. 985,291, Dec. 4, 1992, Pat. No. 5,306,410.

[51] Int. Cl.[6] ..... C25B 9/04

[52] U.S. Cl. ..... 204/1.11; 204/228; 204/242; 204/279; 437/179

[58] Field of Search ..... 204/279, 243 R–247, 204/228, 250–251, 219, 253, 267, 268, 1.11, 71, 242; 439/179

[56] References Cited

U.S. PATENT DOCUMENTS

| | | | |
|---|---|---|---|
| 2,512,206 | 6/1950 | Holden et al. | 204/243 R |
| 2,685,566 | 8/1954 | Schmidtt | 204/243 R |
| 3,023,393 | 2/1962 | Oliver | 439/179 |
| 3,503,034 | 3/1970 | Appleton | 439/179 |
| 3,591,483 | 7/1971 | Loftfield et al. | 204/252 |
| 3,622,944 | 11/1971 | Tsuchiya et al. | 339/118 |
| 3,644,862 | 2/1972 | Otake et al. | 337/408 |
| 3,690,697 | 6/1976 | Kircher et al. | 204/252 |
| 3,723,287 | 3/1973 | Elliott et al. | 204/243 R |
| 3,873,437 | 3/1975 | Pulver | 204/254 |
| 3,878,082 | 4/1975 | Gokhale | 204/226 |
| 3,883,415 | 5/1975 | Shibata et al. | 204/258 |
| 4,211,629 | 7/1980 | McCutchen et al. | 204/252 |
| 5,266,176 | 11/1993 | Muret et al. | 204/279 X |

FOREIGN PATENT DOCUMENTS

| | | |
|---|---|---|
| 0466226A1 | 7/1991 | France . |
| 0466156A1 | 7/1991 | United Kingdom . |

OTHER PUBLICATIONS

"Cerro Alloy Physical Data-Applications", brochure of Cerro Metal Products, division of Cerro Corporation, Bellefonte, Pa.

*Primary Examiner*—Donald R. Valentine
*Attorney, Agent, or Firm*—David P. Gordon

[57] ABSTRACT

Methods and apparatus are provided for coupling two similar or different types of bus bar conductors, where a conductor strap of each bus bar is submersed in a low melting point conductive alloy contained in a chamber. One of the conductor straps may be fabricated to include the chamber for containing the alloy. The chamber is preferably designed to provide ample room for movement of the conductor straps resulting from expansion or contraction of the bus bars. By providing sufficient room and depth in the chamber, the system can maintain its connection even when subjected to seismic shocks. According to different aspects of the invention, the chamber containing the low melting point conductive alloy can be used: to effect an aluminum to copper conductor coupling; to avoid corrosion problems; to act as an electrical coupler for vibration producing electrical equipment such as motors, generators, transformers, etc.; and to act as an electrical switch or circuit breaker. Where used as an electrical switch or circuit breaker, either the chamber is provided with a draining mechanism so that the switch is opened by draining the alloy from the chamber, or the chamber or one of the conductors is provided with a lifting or lowering mechanism for moving the chamber or one of the conductors in order to break the circuit.

20 Claims, 4 Drawing Sheets

METHODS AND APPARATUS FOR ELECTRICALLY COUPLING ELECTRICAL CONDUCTORS WITH A CONDUCTIVE ALLOY HAVING A LOW MELTING POINT

This application is a continuation-in-part of application Ser. No. 07/985,291, filed Dec. 4, 1992, now U.S. Pat. No. 5,306,410, which is hereby incorporated herein in its entirety.

BACKGROUND OF THE INVENTION

1. Field of the Invention

The invention relates to electrical connectors. More particularly, the invention relates to methods and apparatus for electrically coupling electrical conductors through a conductive alloy having a low melting point.

2. State of the Art

The electrical coupling of conductors through a liquid metal is well known in the art. One such well known device is the mercury switch where a pair of conductors are disposed in a glass capsule which is partially filled with liquid mercury. An electrical coupling of the conductors is effected by the liquid mercury when the glass capsule is in the appropriate position and the electrical connection is broken when the capsule is in another position.

More recently, it has been known to use low melting point alloys to effect other types of electrical connections. U.S. Pat. No. 3,622,944 to Tsuchiya et al. discloses an electrical connector using a low melting point alloy consisting essentially of gallium and indium which is liquid at room temperature. Conductors are made of a porous solid material impregnated with the low melting point alloy, or, are made of cadmium, bismuth or lead having interfaces between which the low melting point alloy is precipitated. The connector is useful in miniaturized applications to avoid the need for soldering or high contact pressure. In addition, the connector is useful in lowering contact resistance and in eliminating the need to periodically clean contacts.

In the parent of the instant application, a low melting point conductive alloy is used to couple a conductor to the cathode wall of an electrolytic cell. An external metal conductor strap is mounted a spaced distance from the external steel wall of an electrolytic cell where the steel wall is internally joined to the cathodes of the cell, and the interspace between the external metal conductor strap and the external steel wall is filled with an electrical conductor filler metal alloy. The filler metal may be an alloy that melts and becomes liquid at the normal operating temperature of the cell, or may be chosen so that it remains solid at the normal operating temperature of the cell. Alternatively, the filler metal may be an alloy which does not have a precise melting temperature, but rather a melting range through which the alloy first softens, then forms a semi-liquid "slush," and finally becomes a liquid as the temperature is increased. In the case of an alloy which remains solid during operation of the cell, it may be chosen from a group of alloys which expand when solidified so that the filler metal alloy can be heated and poured into the interspace between the conductor strap and the cell wall wherein it is left to cool and expand, thereby forming a tight mechanical bond. Greater efficiency resulting in power savings is produced due to increased electrical and thermal conductivity between the strap and the cell wall. The conductor strap and the steel wall remain in continuous electrical contact across the entire surface area interface between the external metal conductor strap and the external steel wall of the electrolytic cell. Both the conductor strap and the cell wall beneath the conductor strap are protected from oxidation and corrosion.

The present application seeks to apply the concept of a low melting point conductive alloy coupling to other difficult electrical connections. For example, an electrical coupling of copper to aluminum is often a necessity but is difficult to achieve. Welding, brazing, soldering and explosive bonding techniques are expensive and often unreliable. In addition, rigid electrical bus bar systems often require flexible expansion joints which are expensive and often fail because of problems inherent in their design and use. Bus bar systems are used in industry to carry high currents and/or apply large voltages to machinery where the use of wire conductors is impractical. A bus bar is a relatively large substantially rigid copper or aluminum bar suspended from a ceiling or mounted on a wall. Typically, several parallel bus bars carry electrical current throughout a factory where individual machines tap onto the bus bars to obtain electrical power. The dimensions and routing of the bus bars require that flexible expansion couplings be provided at intervals. These flexible couplings usually take the form either of heavy, many stranded metal cables which are welded, soldered, or bolted to adjacent bus bars, or of multiple layers of copper or aluminum strips which are bolted to adjacent bus bars to make a flexible expansion coupling. These expansion couplings are typically designed to accommodate linear movement of the bus bars, as the expansion and contraction of bus bars is substantially linear. Thus, these and other expansion joints are still subject to the hazards of vibration and seismic shock which are nonlinear. In addition, in connecting machinery to bus bars, circuit breakers, switches, and many other electrical connections are often utilized. These circuit breakers, switches, etc., however, are often difficult to manufacture and are subject to damage by oxidation of metal surfaces and corrosion of electrical contacts. When a circuit breaker or switch is operated with high current, arcing between contacts occurs and often damages the contacts, thereby shortening the useful life of the switch or circuit breaker.

SUMMARY OF THE INVENTION

It is therefore an object of the invention to provide reliable and inexpensive methods and apparatus for producing a reliable expansion joint for use with bus bars.

It is also an object of the invention to provide methods and apparatus for the electrical coupling of an aluminum conductor to a copper conductor.

It is another object of the invention to provide methods and apparatus which provides a vibration resistant electrical coupling.

It is still another object of the invention to provide reliable and inexpensive methods and apparatus for safe electrical switching where the electrical contacts are protected from the damaging effects of arcing and arc breaking.

It is also an object of the invention to provide methods and apparatus for effecting electrical couplings and protecting contacts from the disadvantages of oxidation and corrosion.

It is still another object of the invention to provide methods and apparatus for protecting critical electrical couplings from seismic shock damage.

In accord with these objects which will be discussed in detail below, the methods and apparatus of the present invention include methods and means for coupling two similar or different types of bus bar conductors, where a conductor strap of each bus bar is submersed in a low melting point conductive alloy contained in a chamber. One of the conductor straps may be fabricated to include the chamber for containing the alloy. The chamber is preferably designed to provide ample room for movement of the conductor straps resulting from expansion or contraction of the bus bars. In addition, by providing sufficient room and depth in the chamber, the system can maintain its connection even when subjected to seismic shocks.

According to another aspect of the invention, the chamber containing the low melting point conductive alloy is used to effect an aluminum to copper conductor coupling. Such a coupling has applications with respect to bus bars as well as with respect to other technologies. Such a coupling is utilized to provide relief for expansion and contraction problems, as well as to avoid corrosion problems.

According to yet other aspects of the invention, the chamber containing the low melting point conductive alloy is used as: an electrical coupler for vibration producing electrical equipment such as motors, generators, transformers, rectifiers and other industrial tools; an improved cathode wall coupling for an electrolytic cell where a copper plate is inserted into a chamber formed on the cathode wall and the chamber is filled with low melting point alloy; and an electrical switch or circuit breaker. Where used as an electrical switch or circuit breaker, the chamber is provided with a draining mechanism so that the switch is opened by draining the low melting point conductive alloy from the chamber, and closed by reintroducing the alloy back into the chamber.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
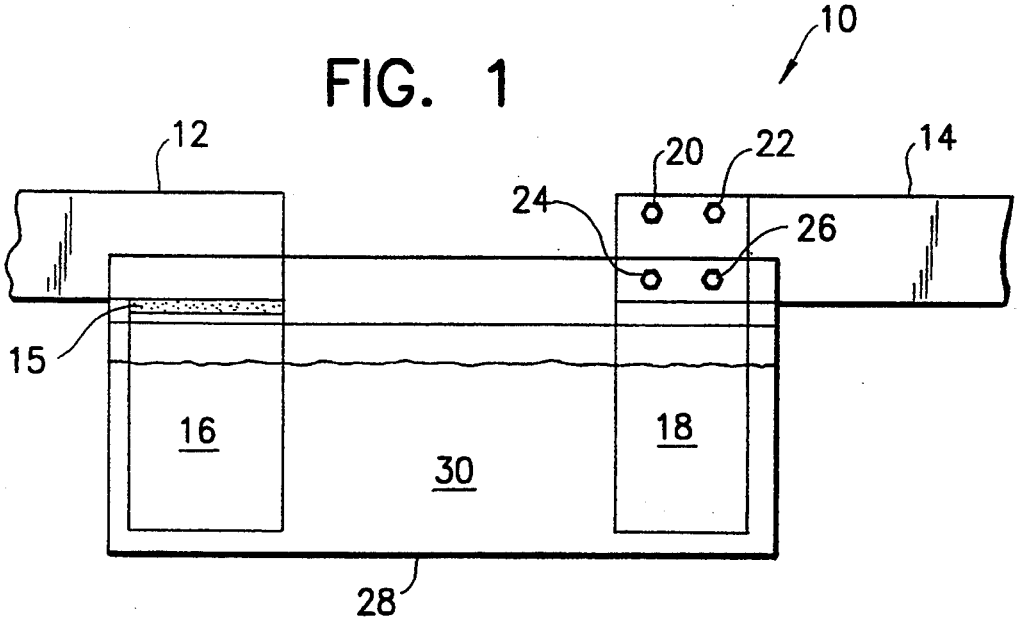
FIG. 1 is a transparent side elevation view of a first embodiment of a copper and aluminum bus bar coupling apparatus according to the invention.

Referring now to FIG. 1, the first electrical coupling 10 according to the invention involves a copper bus bar 12 and an aluminum bus bar 14. The copper bus bar 12 is provided with an end joint or strap 16 which is attached to the bus bar 12 by welding 15, bolting or by simply bending the end of the bus bar 12. The aluminum bus bar 14 is similarly provided with an end joint or strap 18 which is shown in this embodiment as bolted to the end of the bus bar 14 with bolts 20–26'. Alternatively, the joint 18 in the bus bar 14 may be formed by bending or welding. The respective end joints 16, 18 of the bus bars 12, 14 are immersed in a low melting point conductive alloy 30 carried in a chamber 28. The chamber 28 may be formed as part of one of the bus bars 12, 14, or may be a separate unit suspended from a ceiling or mounted on a wall. In addition, the chamber 28 may be conductive or nonconductive. Preferably, if it is conductive, it is made of copper and made a part of a copper bus bar. If it is to be mounted on a wall, it is preferably formed from a nonconductive material, e.g. fiberglass. The top of the chamber 28 need not be covered, but may be provided with a shroud or cover (not shown) to protect the alloy from ambient elements and/or to protect personnel from entering the chamber with a hand or an instrument. The dimensions of the chamber 28 are preferably such that when the bus bars 12, 14 expand or contract, the end joints 16, 18 move relative to each other while remaining within the chamber 28. Moreover, the height, width, and length dimensions of the chamber 28 are preferably chosen such that if the bus bars 12, 14 are subjected to nonlinear movement as a result of vibratory or seismic shock, the electrical coupling is maintained. Thus, it will be appreciated that the coupling 10 also serves as an harmonic isolator protecting one bus bar from the vibration of the other bus bar and for maintaining an electrical coupling of the bus bars in the event of a seismic shock. It will also be appreciated that the electrical coupling 10 shown in FIG. 1 can be used with aluminum bus bars, copper bus bars, or a combination of copper and aluminum bus bars.

Figure 2:
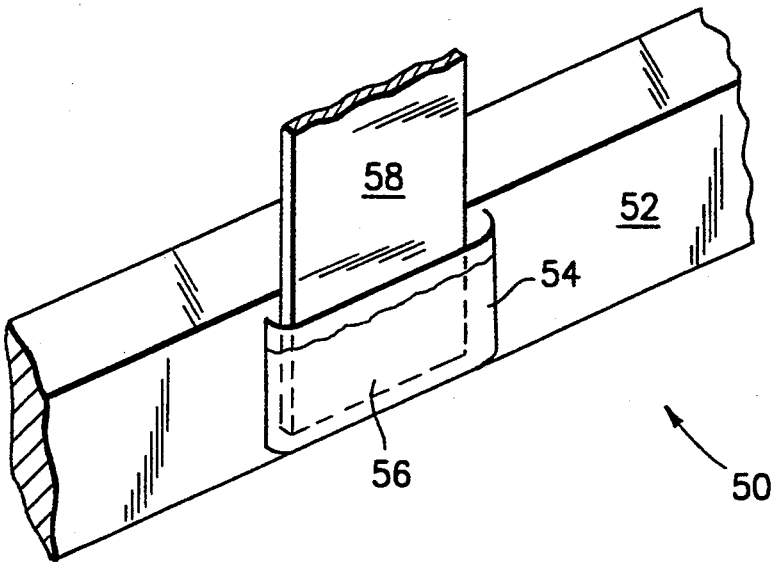
FIG. 2 is a transparent perspective view of a second embodiment of a copper and aluminum bus bar coupling apparatus.

FIG. 2 shows another kind of electrical coupling 50 according to the invention. Here, a first (aluminum) bus bar 52 is provided with a pocket chamber 54 which is welded to the bus bar 52. The pocket chamber 54 is partially filled with a low melting point conductive alloy 56 and a second (copper) bus bar 58 is inserted into the pocket. Electrical coupling is effected from the surface of the second (copper) bus bar 58 through the alloy 56 and to the surface of the first (aluminum) bus bar 52. It will be appreciated that the copper and aluminum materials in FIG. 2 may be reversed so that a copper bus bar is provided with a pocket chamber for receiving an aluminum bus bar, and that the two bus bars could be formed from the same material, e.g. copper or aluminum. It will also be appreciated that the chamber is preferably sized to permit relative movement of the bus bars.

Figure 3:
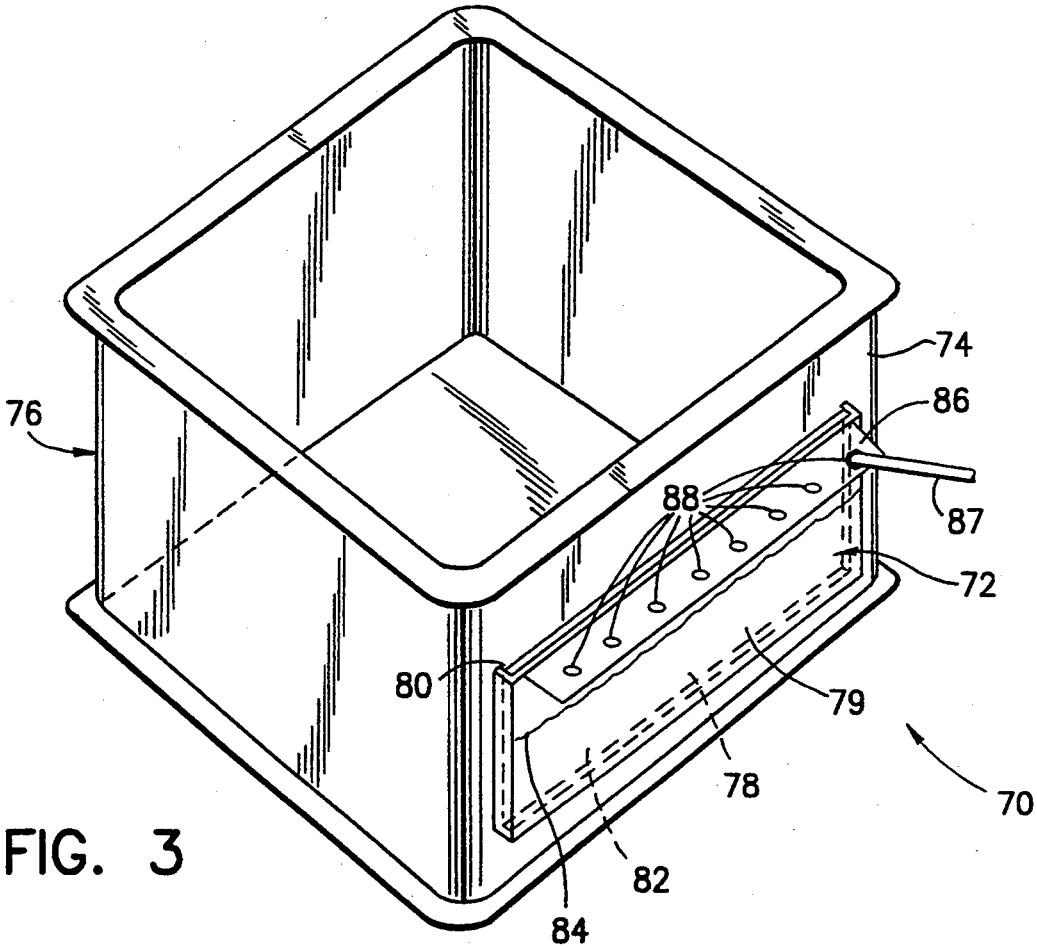
FIG. 3 is a perspective view of a copper electrode to cathode wall coupling.

FIG. 3, shows yet another electrical coupling 70 according to the invention. Here a pocket chamber 72 is welded to the cathode wall 74 of an electrolytic cell 76. The pocket chamber 72 is similar to that described with reference to FIG. 4 of the parent application hereto. Essentially, the pocket chamber 72 creates a fluid containing interspace 78 between the outer wall 79 of the pocket 72 and the cathode wall 74 of the electrolytic cell 76. The pocket 72 is provided with an open top portion 80 which allows access to the interspace 78. According to the present invention, a copper plate 82 is inserted through the open top 80 of the pocket 72 into the interspace 78. The interspace 78 is filled with a low melting point conductive alloy 84 which provides an electrical coupling between the surface of the copper plate 82 and the cathode wall 74. As seen in FIG. 3, the copper plate 82 is preferably provided with an upper flange 86 which includes a plurality of holes 88 for mechanically and electrically coupling the plate 82 to a cable 87.

Figure 4:
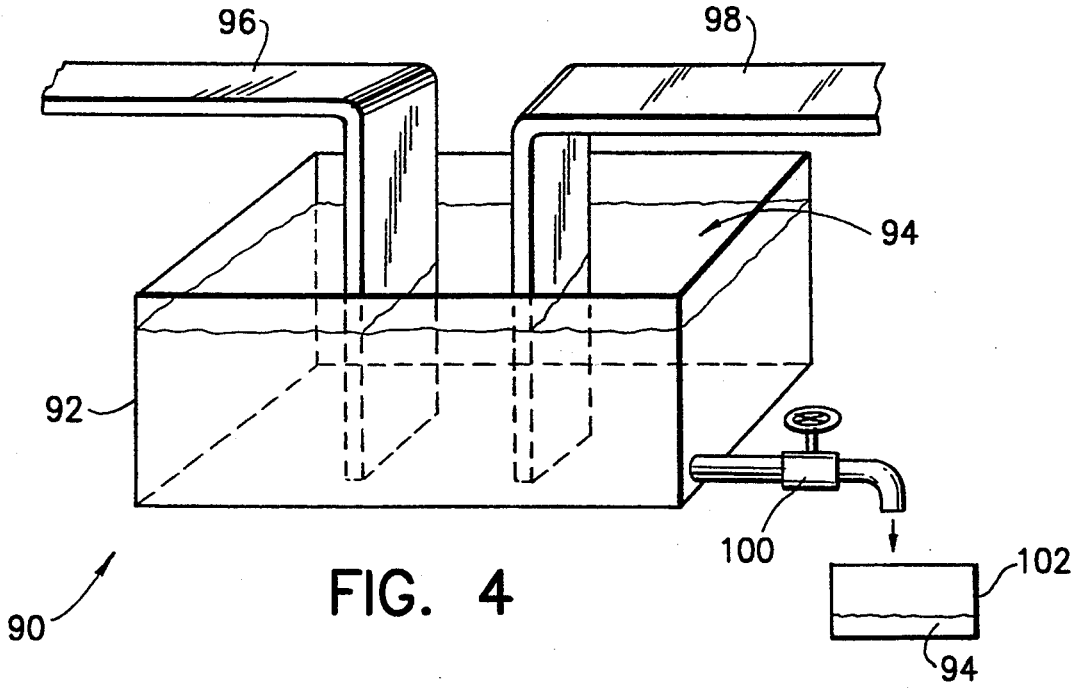
FIG. 4 is a schematic view of a first embodiment of a circuit breaking switch according to the invention.

As mentioned above, the concept of the present invention can be applied to a circuit breaker switch such as the switch 90 which is shown schematically in FIG. 4. As shown in FIG. 4, a circuit breaker switch 90 includes a fluid containing chamber 92 containing a low melting point conductive alloy 94. A pair of conductors 96, 98 are disposed within the chamber 92 and the conductive alloy 94 provides an electrical coupling of the conductors 96, 98. According to the invention, the chamber 94 is provided with a drain valve 100 for draining the low melting point conductive alloy 94 from the chamber 92. The valve 100 may be manually operable, mechanically operable, electromechanically operable, thermally responsive, or any combination of such. From the foregoing, it will be appreciated that when the valve 100 is opened, the low melting point conductive alloy 94 is drained from the chamber 92 and the electrical coupling of the conductors 96, 98 is broken. Depending on the application, it is advantageous to provide a second container 102 for receiving the drained low melting point conductive alloy 94. The second container 102 and the chamber 92 may be formed integrally or as separate units. In addition, if desired, a pump (not shown) may be utilized to pump the conductive alloy 94 back into the chamber 92 in order to reestablish a connection, when desired. Given the above description, it will be appreciated that the switch 90 may be effectively applied as a circuit breaker for breaking an electrical connection in response to virtually any event which can trigger the valve 100. As mentioned above, the valve 100 may be operable by almost any mechanical, thermal, or electrical means as will be appreciated by those skilled in the art.

Figure 4A:
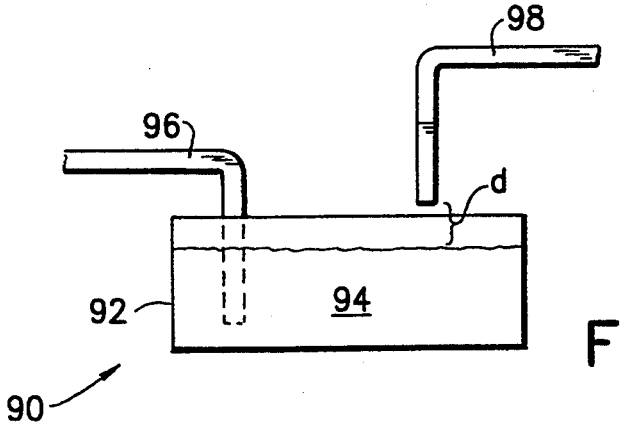
FIG. 4*a* is a schematic view of a second embodiment of a circuit breaking switch according to the invention.

In lieu of a valve 100, one of the conductors, e.g. 98, can be lifted out of the chamber 92 via mechanical, electromechanical or other lifting means (not shown), so as to raise it a distance d above the surface of the alloy 94, as shown in FIG. 4*a*. This will interrupt the electrical coupling of the conductors 96, 98. Moreover, the electrical coupling of conductors 96, 98 can be interrupted by lowering the chamber 92 via lifting/lowering means (not shown) so that the surface of the alloy is a distance d below the conductors 96, 98 as shown in FIG. 4*b*.

Figure 4B:
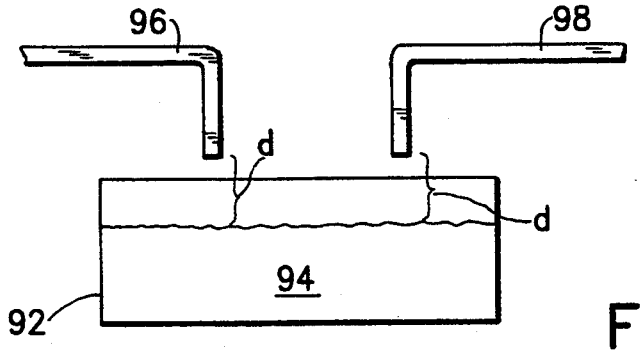
FIG. 4*b* is a schematic view of a third embodiment of a circuit breaking switch according to the invention.

In each of the embodiments of FIGS. 4, 4*a*, and 4*b*, electrical switch contacts are prevented from the bad effects of arcing or corrosion because contact between them is assured through the low melting point conductive alloy 94. Thus, even if the contacts become corroded, pitted, oxidized, or the like, the low melting point conductive alloy 94 will penetrate such corrosion, etc. to assure a good electrical coupling.

Figure 5:
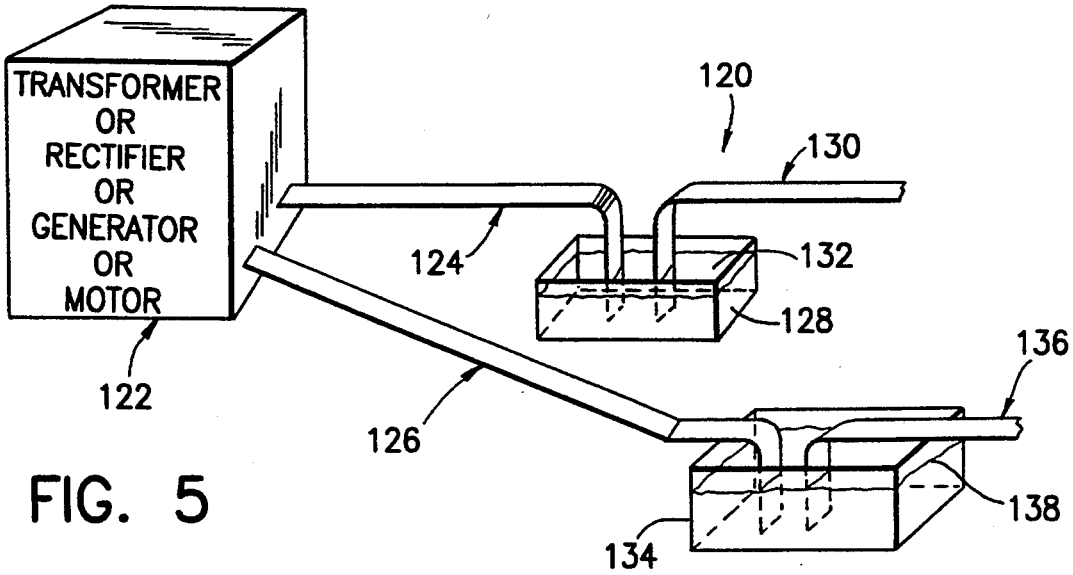
FIG. 5 is a schematic view of a vibration damping connection with an electrical device which generates vibration energy.

Turning now to FIG. 5, the concepts of the present invention are also useful for providing a vibration absorbing (or damping) electrical coupling 120 with an electrical device 122 such as a motor, rectifier, generator, or transformer which is subject to vibration during operation. As shown in FIG. 5, the vibrating electrical device 122 has two rigid electrical conductors (bus bars) 124, 126. Conductor 124 is submersed in a low melting point conductive alloy 132 which is contained in a first chamber 128. A first electrical lead 130 (rigid bus bar) is similarly submersed in alloy 132 which is contained in the first chamber 128. The alloy 132 provides an electrical coupling between the first conductor 124 and the first lead 130. Similarly, the second conductor 126 is submersed in a low melting point conductive alloy 138 which is contained in a second chamber 134. A second electrical lead 136 is similarly submersed in alloy 138 which is contained in the second chamber 134. The alloy 138 provides an electrical coupling between the second conductor 126 and the second lead 136. The mechanical coupling of the conductors 124, 126 relative to the alloys 132, 138 is "free floating" so that the conductors 124, 126 are free to move multidirectionally within chambers 128, 134 while still maintaining electrical contact with the alloys 132, 138. As with the chambers described above, the chambers 128, 134 need not be covered, but a cover may be provided for safety and/or environmental reasons. If the chambers are uncovered, they should be tall enough to avoid a spilling of the alloy when the motor conductors 124, 126 are vibrated therein. Moreover, the chambers may be either conductive or nonconductive. It will therefore be appreciated that as the motor 122 vibrates during operation, the electrical coupling of the conductors 124, 126 relative to the leads 130, 136 remains shock resistant and is prevented from shaking loose. In addition, when the conductors and leads are rigid bus bars, vibrations of the conductor bus bars are not transferred to the lead bus bars.

Figure 6:
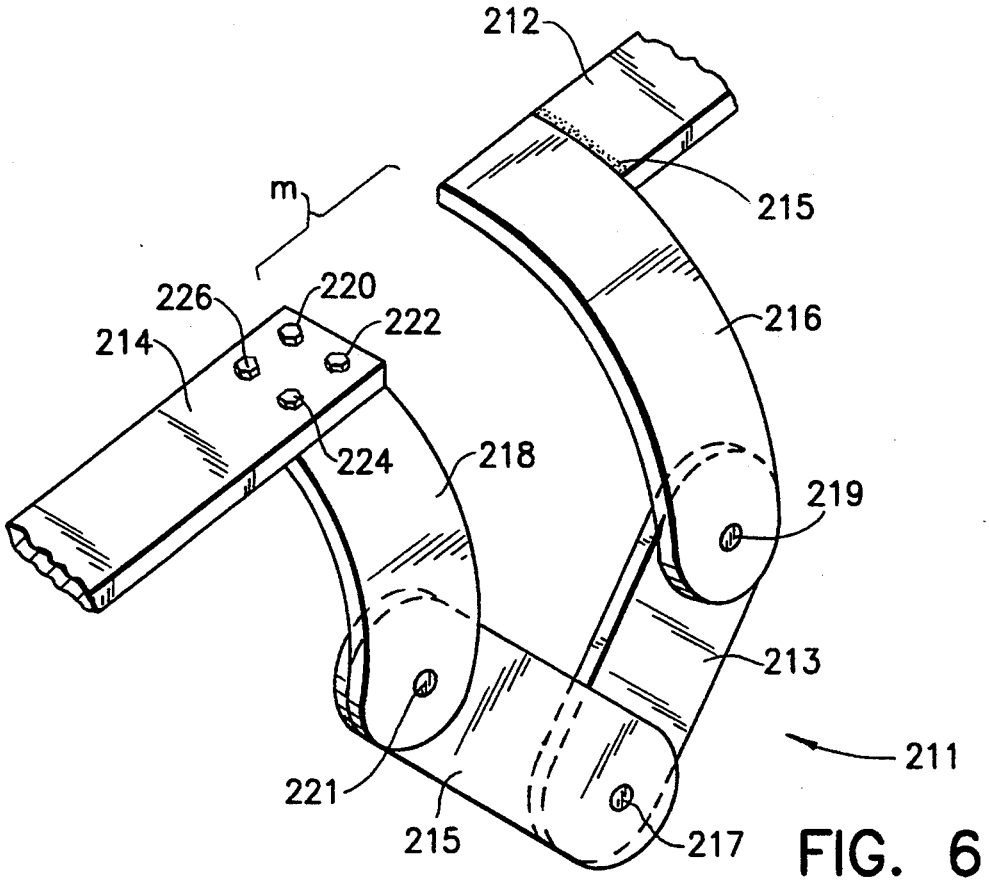
FIG. 6 is a perspective view of a bus bar expansion joint.
Figure 6A:
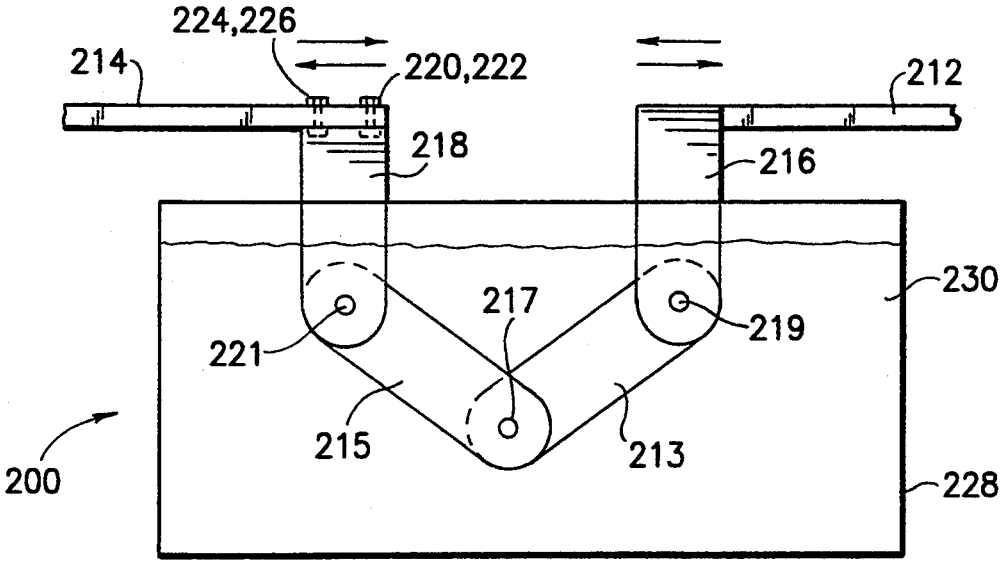
FIG. 6*a* is a transparent side elevation view of the expansion joint of FIG. 6 submersed in a low melting point conductive alloy according to the invention.

An alternate embodiment of the bus bar coupling of FIG. 1 is shown in FIGS. 6 and 6*a* where a first bus bar 212 is provided with an end extension 216 which is welded or brazed at 215 to the end of the bus bar 212. A second bus bar 214 is provided with an end extension 218 which is tightly bolted by bolts 220–226 to the end of the bus bar 214. Each of the end extensions 216, 218 is mechanically coupled to the other by a scissor joint 211. The scissor joint 211 includes a first member 213 and a second member 215 which are rotatably coupled to each other at 217. The first member 213 is also rotatably coupled at 219 to the end extension 216 and the second member 215 is also rotatably coupled at 221 to the end extension 218. The scissor joint 211 is dimensioned to provide a space m for expansion and contraction of the bus bars 212, 214 relative to each other. According to the invention, the scissor joint 211 and at least a portion of the end extensions 216, 218 are submersed in a low melting point conductive alloy 230 carried in a chamber 228. This embodiment of the invention is similar to the embodiment of FIG. 1, above, except that movement of the bus bars relative to each other is limited to being linear rather than multidimensional. Although the scissor joint 211 provides an electrical linking of the bus bars, the electrical coupling is assured through the low melting point conductive alloy 230.

In all of the above embodiments of the invention, the selection of the low melting point conductive alloy is based on particulars such as price and availability, but also on electrical and thermal conductivity, coefficient of expansion, melting point, melting range, operating temperature of the electrical connection, ambient temperature, and the desired electrical current density, among other considerations. Some suitable metals include, but are not limited to alloys containing metals selected from the group bismuth, lead, tin, cadmium, indium, silver, copper, gallium and gold.

There have been described and illustrated herein several embodiments of methods and apparatus for electrically coupling electrical conductors with a conductive alloy having a low melting point. While particular embodiments of the invention have been described, it is not intended that the invention be limited thereto, as it is intended that the invention be as broad in scope as the art will allow and that the specification be read likewise. Thus, while particular containers and chambers have been disclosed for containing the alloy, it will be appreciated that other types of containers could be utilized. Also, while copper and aluminum conductors have been shown, it will be recognized that other types of conductors could be used with similar results obtained. Moreover, while particular configurations have been disclosed in reference to pockets for receiving alloy and conductors, it will be appreciated that other configurations could be used as well. Furthermore, while the circuit breaking switch has been disclosed as having a drain valve, it will be understood that different draining devices such as frangible membranes and the like can achieve the same or similar function as disclosed herein. It will therefore be appreciated by those skilled in the art that yet other modifications could be made to the provided invention without deviating from its spirit and scope as so claimed.

I claim:

1. An apparatus for electrically coupling a first bus bar with a second bus bar, said apparatus comprising:
- a) a fluid container; and
- b) a low melting point conductive metal alloy contained within said fluid container, wherein
  - a first end of the first bus bar is submersed in said low melting point conductive metal alloy, and a first end of said second bus bar is submersed in said low melting point conductive metal alloy, and said fluid container is sized to permit relative movement of said first bus bar relative to said second bus bar while maintaining said first ends of said first and second bus bars in said fluid container.

2. An apparatus according to claim 1, wherein:
said fluid container is large enough to permit both said first end of said first bus bar and said first end of said second bus bar to move in said fluid container.

3. An apparatus according to claim 1, wherein:
said fluid container is physically coupled to said first bus bar and said first end of said second bus bar is free to move within said fluid container.

4. An apparatus according to claim 1, wherein:
said first bus bar is aluminum and said second bus bar is copper.

5. An apparatus according to claim 1, wherein:
one of said first end of said first bus bar and said first end of said second bus bar has an angled joint.

6. An apparatus according to claim 1, wherein:
said fluid container is dimensioned so that one of said first end of said first bus bar and said first end of said second bus bar is free to move relative to the other in more than one dimension.

7. An apparatus according to claim 1, wherein:
said first end of said first bus bar and said first end of said second bus bar are mechanically coupled to each other.

8. An apparatus for electrically coupling a first bus bar with a second bus bar, said apparatus comprising:
- a) a fluid container mechanically coupled to a portion of the first bus bar; and
- b) a low melting point conductive metal alloy contained within said fluid container, wherein
  - an end of said second bus bar is submersed in said low melting point conductive metal alloy, and is free to move relative to said fluid container.

9. An apparatus according to claim 8, wherein:
said fluid container is formed as a pocket on said first bus bar, said pocket having an open end.

10. An apparatus according to claim 8, wherein:
one of said first and second bus bars is aluminum and the other is copper.

11. A method for electrically coupling a first bus bar with a second bus bar, said method comprising:
- a) providing a fluid container containing a low melting point conductive metal alloy;
- b) submersing an end of the first bus bar within said low melting point conductive metal alloy; and
- c) contacting a portion of the second bus bar with said low melting point conductive metal alloy, wherein
  - an end of the first bus bar is free to move within said fluid container.

12. A method according to claim 11, further comprising:
mechanically coupling said fluid container to the second bus bar.

13. A method according to claim 11, wherein:
said portion of said second bus bar is an end portion.

14. An apparatus for electrically coupling a conductor to a cathode metal surface, said apparatus comprising:
- a) a first conductive metal plate;
- b) first attachment means attaching said first conductive plate to said metal surface to form a pocket interspace between said plate and said surface, said pocket interspace having an upper open end;
- c) a low melting point conductive metal alloy substantially filling said interspace; and
- d) a second conductive plate inserted into said pocket interspace through said upper open end, said second conductive plate being coupled to the conductor.

15. An apparatus for breaking an electrical coupling between a first conductor and a second conductor, said apparatus comprising:
- a) a fluid container;
- b) a low melting point conductive metal alloy contained within said fluid container; and
- c) a valve means for draining said low melting point conductive metal alloy from within said fluid container, wherein
  - a first end of the first conductor is submersed in said low melting point conductive metal alloy, a first end of said second conductor is submersed in said low melting point conductive metal alloy, the electrical coupling being formed in said low melting point conductive metal alloy between the first and second conductors, and the electrical coupling being broken when said low melting point conductive metal alloy is drained from within said fluid container by said valve means.

16. An apparatus according to claim 15, wherein: said first and second conductors are rigid bus bars.

17. A method for breaking an electrical coupling between a first conductor and a second conductor, said method comprising:

a) providing a fluid container with a low melting point conductive metal alloy contained therein;

b) submersing an end of the first conductor in the low melting point conductive metal alloy;

c) submersing an end of the second conductor in the low melting point conductive metal alloy; and d) draining the the low melting point conductive metal alloy from the fluid container to break the electrical coupling between the first and second conductors.

18. An apparatus for vibration resistant electrical coupling of a first conductor with an electrical device which is subject to vibration, the electrical device having a second conductor, said apparatus comprising:

a) a fluid container; and b) a low melting point conductive metal alloy contained within said fluid container, wherein one of a first end of the first conductor and a first end of the second conductor is electrically coupled to said low melting point conductive metal alloy, and the other of the first end of said first conductor and the first end of the second conductor is submersed in said low melting point conductive metal alloy, with at least the other of said first end of said first conductor and the first end of the second conductor being free to move in said fluid container.

19. An apparatus according to claim 18, wherein: said first and second conductors are rigid bus bars.

20. An apparatus for breaking an electrical coupling between a first conductor and a second conductor, said apparatus comprising:

a) a fluid container;

b) a low melting point conductive metal alloy contained within said fluid container, with a first end of the first conductor being submersed in said low melting point conductive metal alloy, and a first end of the second conductor being submersed in said low melting point conductive metal alloy, where an electrical coupling is thereby formed between the first conductor and the second conductor; and c) means for displacing one of i) said fluid container relative to the first conductor and the second conductor, ii) the first conductor relative to said container, and iii) the second conductor relative to said container, such that the electrical coupling between the first conductor and the second conductor is broken.

* * * * *